US010189144B2

(12) United States Patent
Linde

(10) Patent No.: US 10,189,144 B2
(45) Date of Patent: Jan. 29, 2019

(54) WATER-ABRASIVE-SUSPENSION CUTTING SYSTEM

(71) Applicant: ANT APPLIED NEW TECHNOLOGIES AG, Lübeck (DE)

(72) Inventor: Marco Linde, Lübeck (DE)

(73) Assignee: ANT APPLIED NEW TECHNOLOGIES AG, Lübeck (DE)

( * ) Notice: Subject to any disclaimer, the term of this patent is extended or adjusted under 35 U.S.C. 154(b) by 179 days.

(21) Appl. No.: 15/301,499

(22) PCT Filed: Apr. 4, 2014

(86) PCT No.: PCT/EP2014/056814

§ 371 (c)(1),
(2) Date: Oct. 3, 2016

(87) PCT Pub. No.: WO2015/149867

PCT Pub. Date: Oct. 8, 2015

(65) Prior Publication Data

US 2017/0106499 A1 Apr. 20, 2017

(51) Int. Cl.

| | |
|---|---|
| ***B24C 1/04*** | (2006.01) |
| ***B24C 7/00*** | (2006.01) |
| ***B24C 3/12*** | (2006.01) |

(52) U.S. Cl.

CPC ..... *B24C 1/045* (2013.01); *B24C 3/12* (2013.01); *B24C 7/0007* (2013.01); *B24C 7/0023* (2013.01)

(58) Field of Classification Search

CPC ..... B24C 1/045; B24C 3/12; B24C 7/0007; B24C 7/0015; B24C 7/0023; B26F 1/26

See application file for complete search history.

(56) References Cited

U.S. PATENT DOCUMENTS

| | | | | |
|---|---|---|---|---|
| 4,854,090 | A * | 8/1989 | Heron | B24C 1/045 451/101 |
| 2004/0198179 | A1* | 10/2004 | Gadd | B24C 1/045 451/2 |
| 2015/0031270 | A1* | 1/2015 | Miller | B24C 1/045 451/2 |
| 2016/0339560 | A1* | 11/2016 | Hashish | B24C 5/02 |

FOREIGN PATENT DOCUMENTS

| | | | |
|---|---|---|---|
| CN | 1151131 | A1 | 6/1997 |
| DE | 20 2012 001127 | U1 | 5/2012 |
| JP | 61-12661 | U | 1/1986 |

(Continued)

*Primary Examiner* — Timothy V Eley

(74) *Attorney, Agent, or Firm* — McGlew and Tuttle, P.C.

(57) ABSTRACT

A water-abrasive suspension cutting facility with at least one high-pressure source (2) which provides a carrier fluid at a high pressure, with at least one exit nozzle (6), with a high-pressure conduit (4) connecting the high-pressure source (2) to the exit nozzle (6), as well as with an abrasive agent feed lock (16). The abrasive agent feed lock (16) is connected to the high-pressure conduit (4) and includes an entry side shut-off element (26) and an exit-side shut-off element (24). A lock chamber (18) is arranged between the entry side shut-off element (26) and an exit-side shut-off element (24). A suction device (30) is configured for producing a reduced pressure in the lock chamber (18) and is connected to the lock chamber (18).

19 Claims, 4 Drawing Sheets

(56) References Cited

FOREIGN PATENT DOCUMENTS

| | | | |
|---|---|---|---|
| JP | S63-11278 | A | 1/1988 |
| JP | H04-82668 | A | 3/1992 |
| JP | H09-512489 | A | 12/1997 |
| JP | 2008-93802 | A | 4/2007 |
| JP | 2009-166198 | A | 7/2009 |
| JP | 2010-69566 | A | 4/2010 |
| WO | 9529792 | A1 | 11/1995 |
| WO | 2013037405 | A1 | 3/2013 |

* cited by examiner

WATER-ABRASIVE-SUSPENSION CUTTING SYSTEM

CROSS REFERENCE TO RELATED APPLICATIONS

This application is a United States National Phase Application of International Application PCT/EP2014/056814 filed Apr. 4, 2014, the entire contents of which are incorporated herein by reference.

FIELD OF THE INVENTION

The invention relates to a water-abrasive suspension cutting facility with at least one high-pressure source, which provides a carrier fluid at a high pressure, at least one exit nozzle, a high-pressure conduit connecting the high-pressure source to the exit nozzle, as well as with an abrasive agent feed lock.

BACKGROUND OF THE INVENTION

A water-abrasive suspension cutting facility which comprises a lock with a lock chamber permitting the introduction of abrasive agent in the high-pressure region of the cutting facility during running operation is known from WO 2013/037405. With such a facility, the difficultly arises of filling the lock chamber with abrasive agent and emptying it again, in a sufficiently rapid manner, in order to be able to bring an adequately large quantity of abrasive agent into the high pressure region of the facility per unit of time.

SUMMARY OF THE INVENTION

With regard to this problem, it is an object of the invention, to improve a water-abrasive suspension cutting facility, to the extent that a greater abrasive agent quantity can be brought into the high-pressure region per unit of time, and specifically during running operation.

This object is achieved by a water-abrasive suspension cutting facility with the features according to the invention. Preferred embodiments are to be deduced from this disclosure including the attached figures. Thereby, it is to be understood that the subsequently described features can be realized in each case individually or in combination with one another.

The water-abrasive suspension cutting facility according to the invention, in the known manner comprises a high-pressure source, which provides a carrier fluid, in particular water, at high pressure. This, for example, is a high-pressure pump. Other suitable carrier fluids can also be applied instead of water for example. Moreover, at least one exit nozzle is provided, from which the suspension of carrier fluid, i.e. preferably water, and of an abrasive agent, and at high pressure, can be discharged. The exit nozzle in the known manner can be designed for cutting or also for surface machining which is to say for the surface processing of materials. The exit nozzle is connected to the high-pressure source via a high-pressure conduit or a high-pressure flow path, in which an abrasive agent is admixed to the water at high pressure which is provided by the high-pressure source. The high-pressure source provides a carrier fluid at a very high pressure, preferably a pressure of up to 2500 bar or higher. The high-pressure conduit at least in a part-flow can run through a pressure container, in which abrasive agent is located, when admixing the abrasive agent, so that the abrasive agent is carried along which is to say entrained out of the pressure container by the carrier fluid, and a suspension is formed.

An abrasive agent feed lock which comprises an entry-side shut-off element and an exit-side shut off element, with a lock chamber arrange between these, is present, in order during running operation of the cutting facility, to be able to bring abrasive agent from a region with ambient pressure, into the high-pressure region between the high-pressure source and the exit nozzle, i.e. into the high-pressure conduit. The feed lock can be opened to the surroundings by way of opening the entry-side shut-off element, whilst the exit-side shut-off element is simultaneously closed to the high-pressure region. The lock chamber can therefore be filled at ambient pressure. The entry-side shut-off element can be subsequently closed, and a pressure increase carried out in the lock chamber, whereupon the second shut-off element can then be opened, and the contents of the lock chamber can empty at high pressure into the high-pressure conduit, for example into a pressure container. Abrasive agent can hence be brought from the surroundings into the high-pressure region by way of the alternating opening of the shut-off elements with a corresponding pressure relief and pressure subjection of the lock chamber, during running operation. The shut-off elements for example can be designed as ball cocks.

According to the invention, the lock chamber is connected to a suction device which can be activated when the first shut-off element is opened, in order to produce a reduced pressure in the lock chamber, in order to be able to bring abrasive agent into the lock chamber as rapidly as possible when the entry-side shut-off element is open. The abrasive agent is sucked through the opened, entry-side shut-off element into the lock chamber by way of such a reduced pressure produced by the suction device, i.e. a flow of abrasive agent into the lock chamber is assisted at least by way of a reduced pressure in the lock chamber. An abrasive agent reservoir (storage device), from which the abrasive agent is moved into the lock chamber by way of gravity, is preferably arranged above the lock chamber, wherein this movement is at least assisted by the mentioned reduced pressure. The abrasive agent reservoir which is to say storage device can be designed as a hopper, i.e. as a filling funnel, wherein the abrasive agent is preferably kept available in the abrasive agent reservoir in a manner mixed with carrier fluid, i.e. in particular water, so that the abrasive agent can be introduced from the outside into the lock chamber without air inclusions.

The suction device is preferably designed as a cylinder, in which a piston is movable, wherein one end of the cylinder is open to the lock chamber, which is to say is connected to this. The volume in the cylinder enlarges when the piston is moved away from this end of the cylinder, by which means fluid is sucked out of the lock chamber connected to this end of the cylinder, and a reduced pressure or suction is produced in the lock chamber, by way of which abrasive agent can be sucked into the lock chamber given an opened, entry-side shut-off element.

The piston is preferably movable via an electric, pneumatic or hydraulic drive. Thereby, the drive is activated by a control device in a manner such that when the first shut-off element is opened, the piston is moved away from the first end of the cylinder which is connected to the lock chamber, in order to produce a reduced pressure in the lock chamber. The piston and the cylinder are preferably designed in a manner such that the piston is linearly movable in the cylinder. Thereby, the piston is sealed off with respect to the inner wall of the cylinder in a suitable manner.

Particularly preferably, the piston is hydraulically movable, i.e. it comprises a hydraulic drive, wherein the piston is connected to a drive piston in a drive cylinder, and the drive piston in the inside of the drive cylinder can be subjected to carrier fluid from the high-pressure conduit, for moving the piston. One can therefore make do without separate hydraulics for the drive of the piston. Instead, the pressure of the carrier fluid in the high-pressure region or in the high-pressure conduit can be used for the movement of the piston in the suction device. The drive piston can be arranged with the piston of the suction device, in a common cylinder. However, separate cylinders can also be provided. The drive piston and the piston of the suction device preferably move along the same axis, and are connected to one another, preferably in a fixed manner, in a suitable manner for the transmission of force and movement. However, it is also possible to arrange the piston of the suction device and the drive piston relative to one another in a different manner, for example next to one another, and to couple them to one another in a suitable manner for the common movement.

The subjection (impingement) of the drive cylinder with carrier fluid from the high-pressure conduit is preferably effected via valves which are activated by the control device, i.e. in particularly electrically or pneumatically actuated valves.

For this, the drive cylinder is further preferably connected to the high-pressure conduit at least one side of the drive piston, via at least one valve. The cylinder is filled with carrier fluid from the high-pressure conduit when the valve is opened, and the drive piston is subjected to pressure at one side, so that the drive piston can be moved in the drive cylinder in a direction which is away from this side. The piston of the suction device is accordingly co-moved which is to say caught, by way of the described movement coupling, in order to produce a reduced pressure in the lock chamber.

Particularly preferably, the lock chamber via its exits-side shut-off element runs out into a pressure container which is situated in the high-pressure conduit or a branch of the high-pressure conduit. The lock chamber is preferably arranged vertically above the pressure container, so that the contents of the lock chamber can empty into the pressure container solely by way of gravitation force, given an opened, exit-side shut-off element. The pressure container can thereby be the region, in which, as described above, the carrier fluid at high pressure is mixed with the abrasive agent into a suspension. I.e. the abrasive agent is flushed out of the pressure container by way of the flow of carrier fluid. The suspension flow downstream of the pressure container then enters into the exit nozzle and is discharged through this. Thereby, preferably only a part-flow or one of several parallel flow paths of the high-pressure conduit is led through such a pressure container.

According to a particular embodiment of the invention, a main branch of the high-pressure conduit, departing from the high-pressure source however extends past the pressure container, and the pressure container is situated in an auxiliary branch which is parallel to the main branch, wherein the main branch and the auxiliary branch unify upstream of the exit nozzle. The main branch thus forms a bypass which is not led through the pressure container. With this design, it is only the flow in the auxiliary branch which is used for delivering the abrasive agent out of the pressure container. I.e. the flow from the auxiliary branch firstly mixes with the abrasive agent in the pressure container and delivers the abrasive agent to a mixing point, at which the auxiliary branch and main branch unify. There, the suspension from the auxiliary branch is further diluted by the flow in the main branch, and that suspension which later exits from the exit nozzle further downstream is formed.

According to a further preferred embodiment, the lock chamber is connected via pressure conduit to the high-pressure conduit, wherein a first pressure compensation valve in the form of a shut-off valve is arranged in the pressure conduit, and wherein the lock chamber can be subjected to pressure by way of opening this first pressure-compensation valve. The shut-off valve can be designed in any suitable manner for switching a high pressure, as has been mentioned above. The shut-off valve is preferably designed as a needle valve. The shut-off valve can be actuated electrically, pneumatically, hydraulically or in another suitable manner and is preferably activated by a control device of the complete system. A connection between the high-pressure region, i.e. between the high-pressure conduit, and the lock chamber, is created by way of opening the shut-off valve, so that carrier fluid can flow into the lock chamber at high pressure and thus increase the pressure in the lock chamber to essentially the same level as in the high-pressure conduit. The pressure in the lock chamber can therefore be increased after the closure of the entry-side shut-off element of the lock chamber, before the exit-side shut-off element is opened. A pressure compensation with the high-pressure conduit is hence created in the lock chamber before the opening of the exit-side shut-off element.

Further preferably, the lock chamber is connected to a drain conduit, which via a second pressure-compensation valve in the form of a shut-off valve is connected to a pressureless run-off, wherein the drain conduit can be opened to the pressureless run-off by way of opening the second pressure compensation valve. The second pressure compensation valve can be designed in a manner corresponding to the pressure-compensation valve mentioned above. The second pressure compensation valve is utilized for reducing the pressure in the inside of the lock chamber, in particular essentially to ambient pressure, after the closure of the exit-side shut-off element and before the opening of the entry-side shut-off element. Only when the pressure in the lock chamber is suitably reduced is the entry-side shut-off element then opened, in order to again fill the lock chamber anew with abrasive agent.

According to a further preferred embodiment, the lock chamber can be connected to a drain conduit which ends in a pressure space of an accumulator. This can be a separate drain conduit or also the drain conduit which additionally runs into a pressureless run-off via a shut-off valve. It is possible to relieve the pressure in the lock chamber into the accumulator via the drain conduit connected to the pressure space of an accumulator, so that no or little fluid needs to be drained to the outside from the lock chamber. A pressure compensation or a pressure reduction can thus be effected in a closed system. Thereby, a combination of the use of an accumulator with a pressureless run-off is also possible, in a manner such that firstly the pressure is reduced by a certain amount by way of bringing fluid into the accumulator and the residual pressure is reduced by way of opening the shut-off valve to the pressureless run-off.

The accumulator is further preferably a cylinder accumulator, and the drain conduit is connected to a first pressure space of the cylinder accumulator, in which a piston separating the first pressure space from a second pressure space is movably arranged. The second pressure space can thereby be subjected to pressure and relieved of pressure, preferably via at least one valve. If the piston is located in a first position, in which it reduces the size of the first pressure space to a minimum, then the second pressure space can be pressure-relieved via a valve, so that fluid or water can flow via the drain conduit out of the lock chamber into the first pressure space, wherein the piston moves into the second pressure space and reduces the size of this, whilst the first pressure space enlarges. The piston can be moved back into its initial position by way of subjecting the second pressure space to pressure. A counter-pressure can be additionally built up via the second pressure space, so that the movement speed of the piston can be controlled or reduced, so that a slower pressure reduction in the lock chamber is possible.

The second pressure space of the cylinder accumulator is further preferably switchably connected to the high-pressure conduit or to a pressureless outlet or run-off, via at least one valve. The valve can be designed in an arbitrarily suitable manner, for example as a needle valve. The valve for example can comprise an electrical, pneumatic or hydraulic drive and is preferably activated by a central control device which controls the filling procedure. The second pressure space is subjected to fluid from the high-pressure conduit when the valve connects the second pressure space of the cylinder accumulator to the high-pressure conduit, so that the piston in the cylinder accumulator can be moved into the first pressure space which is to say in the direction of the first pressure space, so that this reduces in size. If the valve is switched such that the second pressure space is connected to the pressureless outlet, wherein the connection to the high-pressure conduit is simultaneously closed, then the piston can move in the direction of the second pressure space, so that the first pressure space enlarges, in order to receive fluid from the lock chamber. These switching procedures can be realized by way of a suitable valve circuit of one or more valves. E.g. two separate valves can be provided, wherein one valve opens or closes the connection to the high-pressure conduit, and a second valve opens or closes a connection to the pressureless outlet.

Further preferably, a throttle can be arranged in the drain conduit, upstream of the accumulator, i.e. in particular upstream of the cylinder accumulator. This ensures a slowed-down pressure reduction of the pressure in the lock chamber, by way of the fluid flow from the lock chamber to the accumulator being throttled.

According to a further preferred embodiment of the invention, at least one pressure accumulator is arranged in the high-pressure conduit or connected to the high-pressure conduit. This pressure accumulator for example can be designed as an additional volume which is filled with carrier fluid at a high pressure or e.g. as a bubble/bladder accumulator. The pressure accumulator serves for reducing a pressure drop in the high-pressure region, i.e. in the high-pressure conduit, when a pressure compensation in the lock chamber is effected from the high-pressure region or the high-pressure conduit. If, for example, a first pressure compensation valve, as has been described above, is opened, then a connection between the lock chamber, in which atmospheric pressure firstly prevails, and the high-pressure conduit is created. An increase of the pressure in the lock chamber occurs due to this, i.e. a pressure compensation, which however at the other side can lead to a pressure drop in the high-pressure conduit. This pressure drop can be minimized or prevented by a suitable pressure accumulator.

According to a further preferred embodiment of the invention, the lock chamber is connected via the entry-side shut-off element to an exit of the abrasive agent reservoir, wherein a movable closure element which is configured in a hollow manner and is open to an upper end and to a lower end is arranged in the exit, wherein the closure element with its lower end closes the exit and with its upper end extends outwards beyond a maximal filling level for the abrasive agent. The abrasive agent reservoir for example can be designed as a hopper, wherein the exit of the hopper is situated at its lower, tapered end. This exit or outlet runs out into the entry-side shut-off element of the lock chamber. The closure element which closes the exit, for example in the form of a plug, is provided additionally to this entry-side shut-off element. The exit can be opened and closed by way of the vertical movement of the closure element. The closure element however is simultaneously preferably designed such that it has a lower opening which is opened into the exit, and is configured in a hollow manner in its inside. The cavity in the inside of the closure element creates a connection to a second opening at the upper end of the closure element. Thereby, the closure element is configured in such a long manner which is to say has an upwardly extending axial extension, such that the opening at the upper end is situated above the maximal filling level for the abrasive agent in the abrasive agent reservoir. This has the effect that a connection through the cavity in the inside, between the exit and the upper end or the opening at the upper end remains when the closure element closes the exit. However, no abrasive agent can flow into the exit through this opening, since the opening is situated at the upper end above the maximal filling level for the abrasive agent. However, this connection, given a closure of the exit by the closure element, ensures that fluid or water can flow out of the lock chamber through the closure element, given an opened, entry-side shut-off element, wherein it then exits through the opening at the upper end of the closure element. This is useful, since fluid is pressed back into the lock chamber on moving back a piston of the suction device or, as the case maybe, a piston of an accumulator. If this is effected given an open, entry-side shut-off element, then the fluid can be pressed by the closure element into the abrasive agent reservoir. The abrasive agent reservoir is preferably provided with a filling level monitor for the abrasive agent, as well as for fluid, so that it is always ensured that a fluid-abrasive agent mixture is present in the abrasive agent reservoir. The described closure element at its lower end preferably comprises a closure plug, through which a tubular extension creating the connection between the two open ends extends to the upper end.

The closure element with the passage in its inside has the further advantage that it is possible to stop the abrasive agent feed with the help of the closure element, even if the entry-side shut-off element is still opened. It is particularly in this condition that it is possible for water or carrier fluid to be able to flow through the opening in the inside of the closure element, further through the closure element and the entry-side shut-off element, whilst the feed of abrasive agent is prevented for example by the closure plug at the lower end of the closure element. This permits the entry-side shut-off element to be flushed with carrier fluid or water, in order to render this essentially free of abrasive agent before the closure of the entry-side shut-off element.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
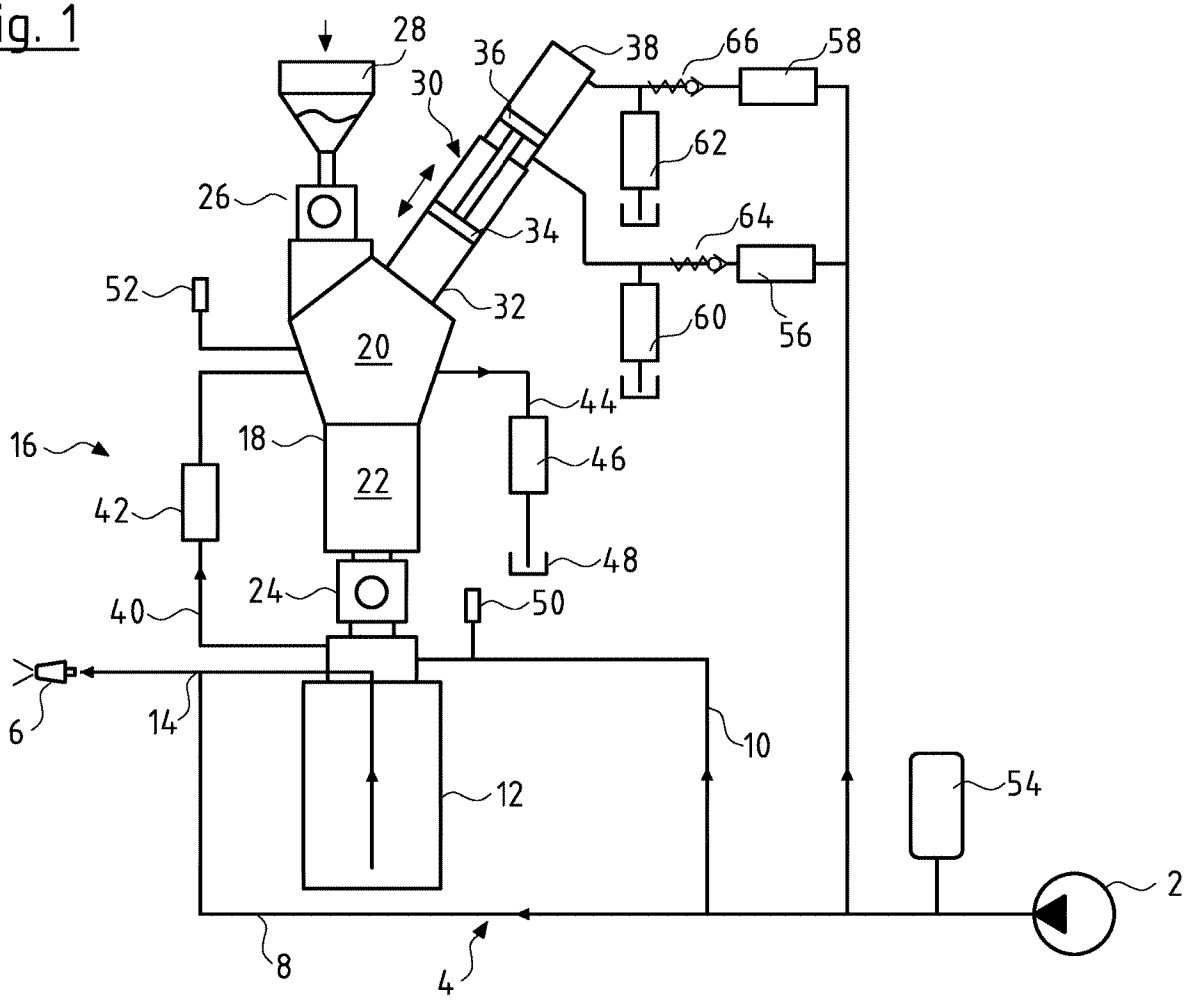
FIG. 1 is a schematic view showing a water-abrasive suspension cutting facility according to a first embodiment of the invention.

Referring to the drawings, the water-abrasive suspension cutting facility which is shown in FIG. 1 comprises a high-pressure source in the form of a high-pressure pump 2 which is connected to an exit nozzle 6 via a high-pressure region or a high-pressure conduit 4. The high-pressure pump 2 provides the water as a carrier fluid at high pressure, wherein the pressure can amount to 2500 bar or more. The high-pressure conduit 4 divides into two parts, specifically a main branch 8 and an auxiliary branch 10. The main branch 8 runs directly from the high-pressure pump 2 to the exit nozzle 6, whereas the auxiliary branch 10 branches from this main branch 8 and forms a bypass which runs through a pressure container 12. An abrasive agent, e.g. a mineral abrasive agent such as garnet sand, corundum, olivines or river sand is located in the pressure container 12. A mixing between abrasive agent and water occurs when the pressure container 12 is subjected to through-flow, so that the water entrains or carries along the abrasive agent, which is to say flushes it out of the pressure container 12. The auxiliary flow 8 at the exit side of the pressure container 12 runs into the main flow 8 again, at a mixing point 14 which is situated upstream of the exit nozzle 6, and thus this auxiliary flow admixes the abrasive agent carried along out of the pressure container 12 to the main flow, so that the final suspension which the exits outwards out of the exit nozzle 6 is formed at the mixing point 14. A valve which is not represented here can be provided in the auxiliary branch 10, in order to disconnect the auxiliary branch 10, by which means the feed of abrasive agent to the water flow can be switched off.

Figure 5:
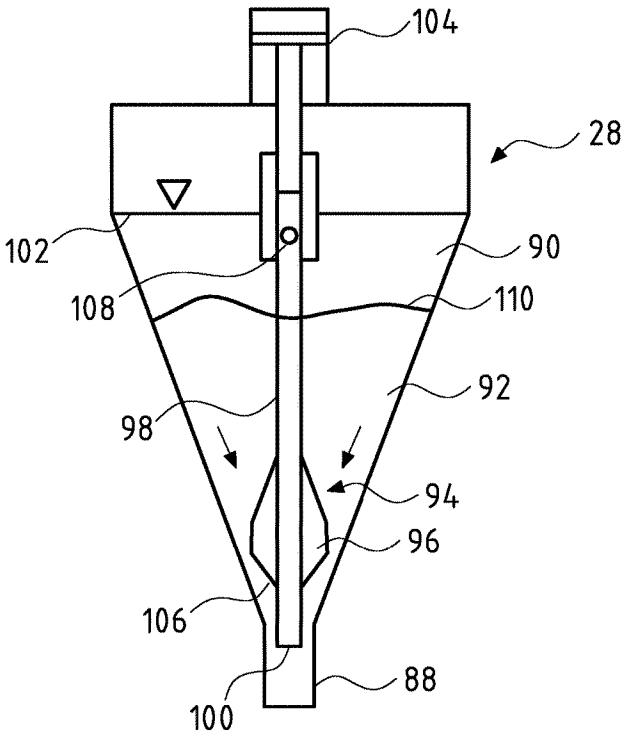
FIG. 5 is a schematic view showing a view of the hopper according to FIG. 4, in the opened condition.
Figure 4:
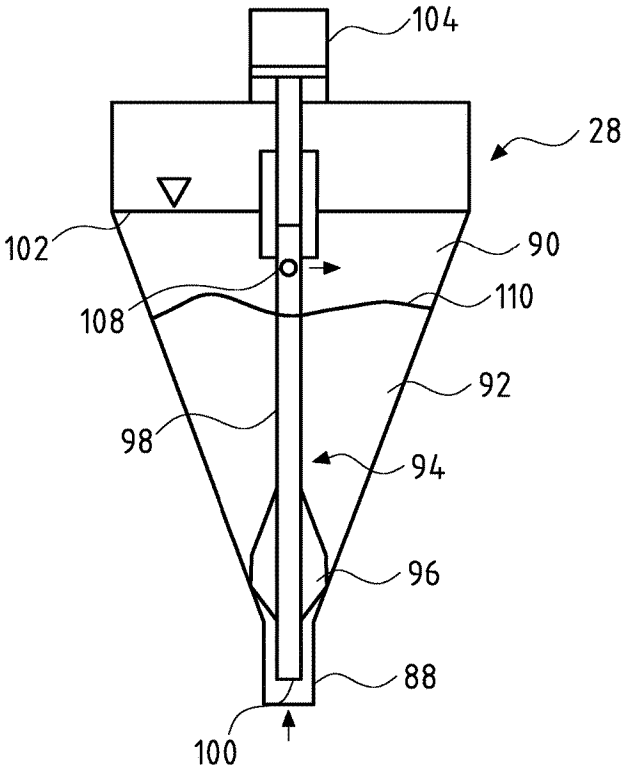
FIG. 4 is a schematic sectioned view of the hopper in FIGS. 1 to 3, in the closed condition.

It is necessary to fill the pressure container 12 again in running operation, for a continuous operation of the facility, since the pressure container 12 is only capable of receiving a certain quantity of abrasive agent. According to the invention, an abrasive agent feed lock 16 is provided for this. This lock comprises a lock chamber 18 which consist of a run-in region 20 as well as an intermediate container 22. The lock chamber 18 is arranged vertically above the pressure container 12 and is separated from this pressure container by an exit-side shut-off element in the form of an exit-side ball cock 24. The lock chamber 18 at the upper end comprises an entry-side ball cock 26 which forms a entry-side shut-off element. A hopper 28 which is described in more detail by way of FIGS. 4 and 5 is arranged vertically above the entry-side ball cock 26. Moreover, a suction device 30 which here comprises a cylinder 32 with a piston 34 which is linearly movable in this connects to the inlet region 20 of the lock chamber 18. The piston 34 is fixedly connected to a drive piston 36 which is linearly movable in a drive cylinder 38 connecting axially onto the cylinder 32.

Moreover, a pressure conduit 40 which branches from the high-pressure conduit 4, in this case from the auxiliary branch 10, runs out into the lock chamber 18. A first pressure compensation valve 42 is arranged in the pressure conduit 40. The lock chamber 18 is moreover connected to a drain conduit 44, in which a second pressure compensation valve 46 is arranged and which runs out into a pressureless run-off 48 downstream of the second pressure compensation valve 46.

A first pressure sensor 50 is arranged on the auxiliary branch 10, and a second pressure sensor 52 on the lock chamber 18. The pressure conduit 4 moreover comprises an accumulator in the form of a pressure accumulator 54.

In the example represented in FIG. 1, a hydraulic drive for the piston 34 of the suction device 30 is provided, wherein this drive is formed by the drive cylinder and the drive piston 36. For this, the drive cylinder 38 at a first side of the drive piston 36 which faces the piston 34 is connected to the high-pressure conduit 4 via a valve 56. Accordingly, the drive cylinder 38 at a second side of the drive piston 36 which is away from the piston 34 is likewise connected to the high-pressure conduit 4 via a further valve 58. A drain valve 60 is moreover arranged at the connection of the valve 56 to the drive cylinder 38. Accordingly, a drain valve 62 is arranged at the connection of the valve 58 to the drive cylinder 38. A check valve 64, 66 is moreover arranged at the exit side of the valves 56 and 58.

A reduced pressure can be produced in the lock chamber 18 when the piston 34 in the cylinder 32 is moved away from the lock chamber 18, i.e. to the drive cylinder 38. This reduced pressure has the effect that with an opened, entry-side ball cock 26, abrasive agent is sucked out of the hopper 28 into the run-in region 20 in the lock chamber 18, by way of a reduced pressure, additionally to the acting gravitational force. The drain valve 62 is opened and the valve 56 simultaneously opened, in order to be able to accordingly move the piston 34 for this, so that the drive piston 36 at its side facing the piston 34 is subjected to pressure and is thus moved in a direction, in which it, together with the piston 34, moves away from the lock chamber 18. Water is sucked out of the lock chamber 18 and a reduced pressure arises in the lock chamber 18, due to the fact that the region of the cylinder 32 which faces the lock chamber 18, i.e. the run-in region 20 of this lock chamber, is connected to this run-in region 20.

The valve 56 is closed, in order to be able to move the piston 34 back in the direction of the lock chamber 18. The drain channel 62 is likewise closed. Conversely, the drain valve 60 and the valve 58 are opened, so that the side of the drive piston 36 which is away from the piston 34 is subjected to pressure, and the drive piston 36 and the piston 34 are hence moved back in the opposite direction.

As a whole, the filling procedure of the pressure container 12 with abrasive agent and according to the invention now takes place as follows. The interior of the lock chamber 18 is firstly relieved from existing residual pressure by way of a brief opening of the second pressure compensation valve 46, wherein fluid flows from the run-in region 20 via the drain conduit 44 into the run-off 48. The pressure compensation valve 46 is thereafter closed again. The piston 34 is moreover moved by the already described drive, into a first end-position, in which it is situated at the end of the cylinder which faces the lock chamber 18, i.e. the end which is away from the drive cylinder 38. I.e. in this condition, the volume of the cylinder 32 which faces the lock chamber 18 and is connected to this is minimal. Given a closed pressure compensation valve 46, the entry-side ball cock 26 is opened with this movement of the piston 34. Thereby, excess water is pressed out of the lock chamber 18 through the entry-side ball cock 26, as described below by way of FIGS. 4 and 4, into the hopper. As explained by way of FIGS. 4 and 5, the exit of the hopper 28 is subsequently opened, so that abrasive agent can enter from the hopper 28 into the run-in region 20 of the lock chamber 18 on account of gravity. The drive piston 36 is moved to the end of the drive cylinder 38 which is away from the cylinder 32, by way of opening the drain valve 62 and the valve 56, in order to assist or to accelerate this entry of abrasive agent. Thereby, the piston 34 is co-moved, so that the volume of the cylinder 32 which faces the run-in region 20 of the lock chamber 18 and is connected to this, enlarges. A reduced pressure is produced in the lock chamber 18 by way of this, on account of which reduced pressure the abrasive agent is additionally sucked out of the hopper 28. The movement of the drive piston 36 as well as of the piston 34 is stopped by way of closure of the valve 56 and the drain valve 62 when the lock chamber 18 has been filled with abrasive agent to a sufficient extent, and the entry-side ball cock 26 of the lock chamber 18 is closed.

The drive cylinder is subsequently subjected to pressure by way of opening the valve 58, such that the drive piston 36 together with the piston 34 is moved forwards, which is to say is moved towards the lock chamber 18, so that the volume in the cylinder 32 and which faces the lock chamber 18 reduces in size. The piston 34 therefore contributes to the pressure build-up in the inside of the lock chamber 18. The first pressure compensation valve 42 is moreover opened, by which means the lock chamber 18 is subjected to the pressure in the high-pressure conduit 4 or in the high-pressure region. I.e., an essentially complete pressure compensation between the high-pressure conduit 4 and the lock chamber 18 takes place. This is monitored by the pressure sensors 50 and 52. A pressure accumulator 54 is present at the high-pressure conduit 4, in order with this pressure compensation to minimize the pressure drop in this. The exit-side ball cock 24 of the lock chamber 18 is opened when a pressure compensation, i.e. the same pressure in the auxiliary branch 10 and in the lock chamber 18 is detected by the pressure sensors, i.e. after the effected pressure compensation, by which means abrasive agent is transferred from the lock chamber 18, i.e. from the intermediate container of the lock chamber 18, into the pressure container 12 due to gravity. The pressure compensation valve 42 preferably remains open with this transfer, in order to permit a drainage of the intermediate reservoir 22 with its emptying. This means that carrier fluid or water can post-flow into the lock chamber 18 via the pressure compensation valve 42 as well as via the pressure conduit 40, whilst abrasive agent gets out of the intermediate reservoir 22 through the opened ball cock 24 into the pressure container 12. The exit-side ball cock 24 is closed again after the complete emptying of the abrasive agent out of the lock chamber 18, which can be detected via further sensors, e.g. light barriers, which are not shown here. The pressure compensation valve 42 is thereby also closed.

In the next step, a pressure compensation is effected between the lock chamber 18 and the atmosphere, by way of the valve 56 being opened given a closed valve 58, by which means the drive piston 36 is moved backwards together with the piston 34, which is to say away from the lock chamber 18. The volume of the cylinder 32 which faces the lock chamber 18 enlarges, and the pressure in the lock chamber 18 is relieved. The second pressure compensation valve 46 is subsequently opened to the run-off 48, for the complete pressure compensation. The second pressure compensation valve 46 is closed after this pressure compensation has been effected, and the entry-side ball cock 26 is again opened. The drive piston 36 is subsequently subjected to pressure by way of opening the valve 58 and opening the drain valve 60, such that the piston 34 in the cylinder 32 is moved again into its end position facing the lock chamber 18 and the fluid is thereby pressed out of the cylinder 32 back into the lock chamber 18 and out of this through the opened entry-side ball cock 26 into the hopper 28, as is explained by way of FIGS. 4 and 5. In the next step, the exit of the hopper 28 is again opened, and the filling of the lock chamber 18 begins afresh. The pressure container 12 can therefore be filled again and again with abrasive agent via the lock chamber 18, with continuous operation of the cutting facility.

Figure 2:
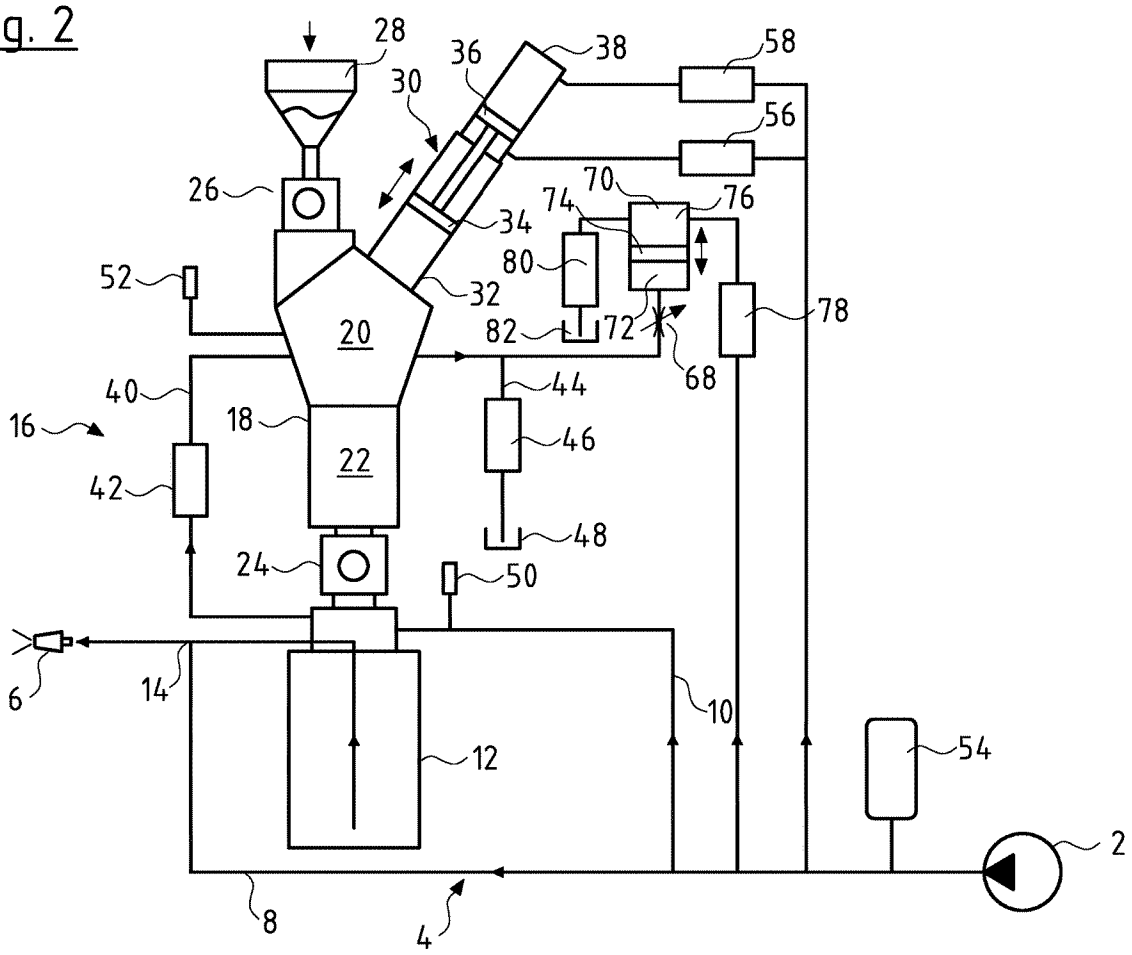
FIG. 2 is a schematic view showing a water-abrasive suspension cutting facility according to a second embodiment of the invention.

FIG. 2 shows a second variant of a water-abrasive suspension cutting facility according to the invention, which with regard to essential parts is constructed identically to the facility according to FIG. 1. It is merely the differences which are described hereinafter. Only the valves 56 and 58 are shown in FIG. 2, as a drive for the drive piston 36. However, it is to be understood that usefully the drain valves 60 and 62 as well as the check valves 64 and 66 could also be arranged according to the design according to FIG. 1. In the example represented in FIG. 2, an accumulator in the form of a cylinder accumulator 70 is additionally connected to the drain conduit 44 via a throttle 68. Thereby, the drain conduit 44 is connected via the throttle 68 to a first pressure space 72 of the cylinder accumulator 70. The first pressure space 72 is separated from a second pressure space 76 in the inside of the cylinder accumulator 70 by a longitudinally displaceable piston 74. The second pressure space 76 is connected via a first valve 78 to the pressure conduit 4 and via a second valve 80 to a run-off 82 which is at ambient which is to say atmospheric pressure. With the example represented in FIG. 2, the pressure relief, i.e. the pressure compensation of the lock chamber 18 to the surrounding pressure can be effected in two steps. In the first step, the pressure compensation is effected via the cylinder accumulator 70, by way of the second valve 80 which forms a drain valve being opened to the run-off 82. This permits fluid to flow through the throttle 68 into the first pressure space 72, and the piston 74 to move in the direction of the second pressure space 76, so that the second pressure space 76 is reduced in size. A remaining residual pressure in the inside of the lock chamber 18 can then be reduced via the second pressure compensation valve 76 in the manner described by way of FIG. 1. The first valve 78 is opened in the closed condition of the second valve 80, in order to move the piston 74 back in the cylinder accumulator 70, so that the second pressure space 76 is subjected to fluid at high pressure, from the high-pressure conduit 4, and the piston 74 is therefore moved back to the first pressure space 72, by which means the second pressure space 72 is reduced in size. A pressure increase in the lock chamber 18 is therefore achieved given a closed ball cock 26. This pressure increase is effected after filling the lock chamber 18 and closure of the ball cock 26, before the further complete pressure compensation by way of opening the pressure compensation valve 42, as has been described above.

Figure 3:
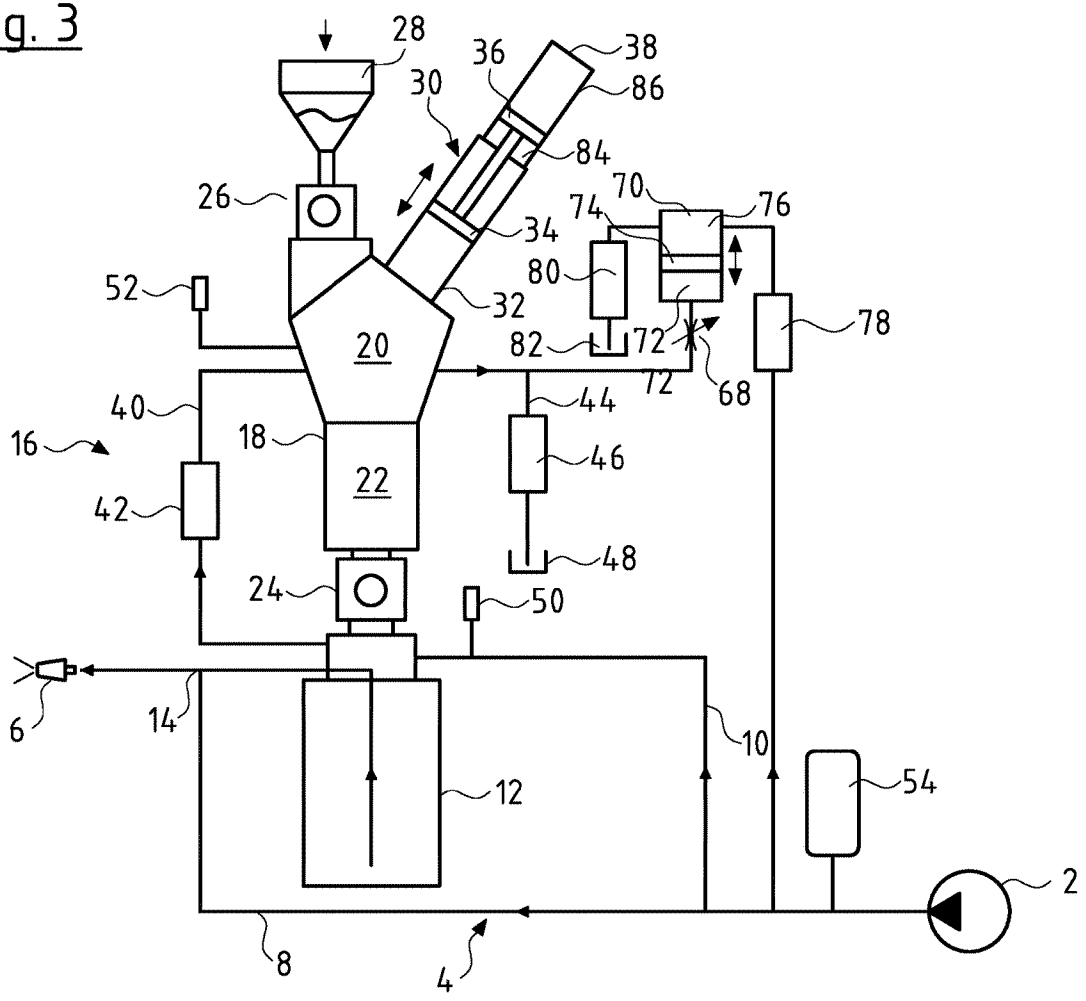
FIG. 3 is a schematic view showing a water-abrasive suspension cutting facility according to a third embodiment of the invention.

A third embodiment of the invention is shown in FIG. 3. This embodiment essentially corresponds to the embodiment shown in FIG. 2, with the single difference that a separate pneumatic drive via pneumatic connections 84 and 86 on the drive cylinder 38 is provided for the drive of the piston 34 of the suction device 30. The pneumatic connections 84 and 86 are subjected to pressure according to the preceding description of the hydraulic variant, in order to move the drive piston 36 together with the piston 34. Accordingly, a separate pneumatic control system is connected to the pneumatic connections 84 and 86, and this system can preferably applied also when other elements of the facility, in particular valves, for example the pressure compensation valves 42 and 46, are pneumatically actuated.

The function of the hopper 28 is described in more detail by way of FIGS. 4 and 5. The hopper 28 at its lower end comprises an exit 88, which as described above is arranged above the entry-side ball cock 26 of the lock chamber 18. The hopper 18 on operation is filled with water 90 and abrasive agent 92, so that the abrasive agent 92 enters into the lock chamber 18 in the wet condition, so that a transfer of air into the lock chamber 18 is prevented.

The inlet of the abrasive agent into the lock chamber 18 is not solely controlled by the entry-side ball cock 26, but additionally via a closure element 94 in the hopper 28. The closure element 94 at its lower end comprises a closure plug 96 which is configured such it can come into sealed engagement with the inner side of the run-in funnel or hopper 28, in a manner surrounding the exit 88, as is shown in FIG. 4. No abrasive agent 92 can enter into the exit 88 in this condition. Additionally, the closure element 94 however comprises a tube 98 which extends through the closure plug 96 to the exit 88 and comprises a lower opening 100 at its lower end. In the opposite direction, the tube 98 extends from the closure plug 96, upwards above the water level 102, up to a pneumatic cylinder 104 arranged on the upper side of the hopper 28. The tube 58 is vertically movable via the pneumatic cylinder 104, so that, as is shown in FIG. 5, it together with the closure plug 96 can be moved into a vertical upper position, in which the closure plug 96 is remote from the inner wall of the hopper 28, so that an annular gap 106 is realized, through which gap the abrasive agent 92 can flow into the exit 88. It is to be understood that any other suitable linear drive could be applied for moving the tube 98 with the closure plug 96, i.e. for moving the closure element 94, in the vertical direction, instead of a pneumatic drive via the pneumatic cylinder 104.

Apart from the lower opening 100, the tube 98 comprises an upper opening 108 which runs out at the outer periphery of the tube 98. The upper opening 108 is situated above the filling level, i.e. the maximal filling level 110 for the abrasive agent 92. This abrasive agent 92 is prevented from being able to get through the upper opening 108 into the exit 88, in the closed condition of the hopper 28 which is shown in FIG. 4. The exit 88 in this condition is closed for the abrasive agent 92 and can only be opened by way of vertically lifting the closure element 94. However, it is simultaneously open to water which flows from below out of the lock chamber 18 through the entry-side ball cock 26 on moving back the piston 34. I.e. this water which can be displaced out of the lock chamber 18 on moving back the piston 34 and, as the case may be, the piston 74, can enter into the lower opening 100 of the tube 98 and exit through the upper opening 108 above the abrasive agent 92 into the hopper 28.

The tube 98 moreover has a further function, specifically for the entry-side ball cock 26 being able to be flushed before the closure of this, in order to remove abrasive agent out of the ball cock 26. For this, the abrasive agent feed is interrupted by way of lowering the closure element 94, before the end of the suction movement of the piston 34. Then however, a reduced pressure continues to exist in the lock chamber 18 on account of the further suction movement of the piston 34, so that water is sucked from the hopper via the upper opening 108, through the tube 98 out of the lower opening 100 and flows through the still opened ball cock 26. Only after this flushing procedure is the ball cock 26 then closed, as has been described for the filling procedure by way of FIGS. 1-3.

Sensors for monitoring the water level 102 as well as the filling level 110 of the abrasive agent 92, and which are not shown here can be additionally arranged on the hopper 28, in order to be able to automatically refill water and abrasive agent. These e.g. can be light barriers. Further filling level sensors, for example in the form of light barriers can be arranged on the intermediate container 22 and well as the pressure container 12. One can detect when the pressure container 12 must be filled, by way of filling level sensors on this container. One can detect when the intermediate container 22 is completely emptied via filling level sensors on this container, so that the lower ball cock 24 can be closed again. One can also detect when the intermediate container 22 is adequately filled with abrasive agent, before the abrasive agent feed from the hopper 28 is interrupted. The complete filling procedure can therefore be automated via a control device.

While specific embodiments of the invention have been shown and described in detail to illustrate the application of the principles of the invention, it will be understood that the invention may be embodied otherwise without departing from such principles.

The invention claimed is:

1. A water-abrasive suspension cutting facility comprising:

at least one high-pressure source, which high pressure source provides a carrier fluid at a high pressure;

at least one exit nozzle;

a high-pressure conduit connecting the at least one high-pressure source to the at least one exit nozzle;

an abrasive agent feed lock, which feed lock is connected to the high-pressure conduit and which feed lock comprises an entry-side shut-off element and an exit-side shut-off element and a lock chamber arranged between the entry-side shut-off element and the exit-side shut-off element; and a suction device configured to be activated when the entry-side shut-off element is opened for producing a reduced pressure in the lock chamber, the suction device being connected to the lock chamber, wherein the lock chamber runs out via the exit-side shut-off element into a pressure container which is situated in the high-pressure conduit or a branch of the high-pressure conduit.

2. A water-abrasive suspension cutting facility according to claim 1, wherein the suction device comprises a cylinder with a piston which is movable in the cylinder, wherein one end of the cylinder is open to the lock chamber.

3. A water-abrasive suspension cutting facility according to claim 2, wherein the piston is movable via an electric, pneumatic or hydraulic drive.

4. A water-abrasive suspension cutting facility according to claim 2, wherein the piston is hydraulically movable, wherein the piston is connected to a drive piston in a drive cylinder, and the drive piston in the inside of the drive cylinder is subjected to carrier fluid from the high-pressure conduit, for moving the piston.

5. A water-abrasive suspension cutting facility according to claim 4, wherein the drive cylinder is connected at least one side of the drive piston to the high-pressure conduit via at least one valve.

6. A water-abrasive suspension cutting facility according to claim 1, wherein departing from the high-pressure source, a main branch of the high-pressure conduit is led past the pressure container, and the pressure container is situated in an auxiliary branch parallel to the main branch, wherein the main branch and the auxiliary branch unify upstream of the exit nozzle.

7. A water-abrasive suspension cutting facility according to claim 1, wherein the lock chamber is connected to the high-pressure conduit via a pressure conduit, wherein a pressure compensation valve in the form of a shut-off valve is arranged in the pressure conduit, and the lock chamber can be subjected to pressure by way of opening the pressure compensation valve.

8. A water-abrasive suspension cutting facility according to claim 1, wherein the lock chamber is connected to a drain conduit which is connected to a pressureless run-off via a second pressure-compensation valve in the form of a shut-off valve, wherein the drain conduit can be opened to the pressureless run-off by way of opening the second pressure compensation valve.

9. A water-abrasive suspension cutting facility according to claim 1, further comprising a drain conduit, an accumulator with a pressure space, wherein the lock chamber is connected to the drain conduit which ends in the pressure space of the accumulator.

10. A water-abrasive suspension cutting facility according to claim 9, wherein the accumulator comprises a cylinder accumulator, and the drain conduit ends in the pressure space comprising a first pressure space of the cylinder accumulator, in which cylinder accumulator a piston, separating the first pressure space from a second pressure space, is movably arranged, wherein the second pressure space can be subjected to pressure and relieved of pressure, via at least one valve.

11. A water-abrasive suspension cutting facility according to claim 10, wherein the second pressure space of the cylinder accumulator can be switchably brought into connection with the high-pressure conduit or with a pressureless outlet, via the at least one valve.

12. A water-abrasive suspension cutting facility according to claim 9, wherein a throttle is arranged in the drain conduit, upstream of the accumulator.

13. A water-abrasive suspension cutting facility according to claim 1, further comprising at least one pressure accumulator, wherein the high-pressure conduit is connected to the at least one pressure accumulator.

14. A water-abrasive suspension cutting facility according to claim 1, further comprising an abrasive agent reservoir with an exit and a movable closure element arranged in the exit, the abrasive agent reservoir containing an abrasive agent, wherein the lock chamber is connected via the entry side shut-off element to the exit of the abrasive agent reservoir, wherein said closure element has a hollow configuration that is open to an upper and to a lower end, wherein the closure element lower end closes the exit and with upper end extends beyond a maximal filling level for the abrasive agent.

15. A water-abrasive suspension cutting facility comprising:

at least one high-pressure source, which high pressure source provides a carrier fluid at a high pressure;

at least one exit nozzle;

a high-pressure conduit connecting the at least one high-pressure source to the at least one exit nozzle;

an abrasive agent feed lock, which feed lock is connected to the high-pressure conduit and which feed lock comprises an entry-side shut-off element and an exit-side shut-off element and a lock chamber arranged between the entry-side shut-off element and the exit-side shut-off element;

a suction device connected to the lock chamber; and a drain conduit, an accumulator with a pressure space, wherein the lock chamber is connected to the drain conduit which ends in the pressure space of the accumulator.

16. A water-abrasive suspension cutting facility according to claim 15, wherein the accumulator comprises a cylinder accumulator, and the drain conduit ends in the pressure space comprising a first pressure space of the cylinder accumulator, in which cylinder accumulator a piston, separating the first pressure space from a second pressure space, is movably arranged, wherein the second pressure space can be subjected to pressure and relieved of pressure, via at least one valve.

17. A water-abrasive suspension cutting facility according to claim 16, wherein the second pressure space of the cylinder accumulator can be switchably brought into connection with the high-pressure conduit or with a pressureless outlet, via the at least one valve.

18. A water-abrasive suspension cutting facility according to claim 15, wherein a throttle is arranged in the drain conduit, upstream of the accumulator.

19. A water-abrasive suspension cutting facility comprising:

at least one high-pressure source, which high pressure source provides a carrier fluid at a high pressure;

at least one exit nozzle;

a high-pressure conduit connecting the at least one high-pressure source to the at least one exit nozzle;

an abrasive agent feed lock, which feed lock is connected to the high-pressure conduit and which feed lock comprises an entry-side shut-off element and an exit-side shut-off element and a lock chamber arranged between the entry-side shut-off element and the exit-side shut-off element; and a suction device connected to the lock chamber, wherein the lock chamber is connected to a drain conduit which is connected to a pressureless run-off via a second pressure-compensation valve in the form of a shut-off valve, wherein the drain conduit can be opened to the pressureless run-off by way of opening the second pressure compensation valve.

* * * * *